United States Patent [19]

Wood et al.

[11] 4,455,251

[45] Jun. 19, 1984

[54] AQUEOUS SOLUTION OF ALKALI METAL COMPOSITIONS

[75] Inventors: William G. Wood, Grosse Pointe Farms; John F. Pilznienski, Dearborn Heights, both of Mich.

[73] Assignee: Kolene Corporation, Detroit, Mich.

[21] Appl. No.: 419,826

[22] Filed: Sep. 20, 1982

[51] Int. Cl.[3] ..... C11D 7/06; C11D 7/10

[52] U.S. Cl. ..... 252/156; 134/10; 134/11; 148/20; 203/90; 203/100; 252/1; 266/120; 423/395; 423/658.5; 423/659; 423/DIG. 12

[58] Field of Search ..... 134/10, 11; 203/90, 203/100; 148/20; 252/1, 156; 266/120; 423/395, 658.5, 659, DIG. 12

[56] References Cited

U.S. PATENT DOCUMENTS 4,109,897 8/1978 Mehrkam ..... 266/120
4,113,511 9/1978 Shoemaker et al. ..... 134/10
4,273,591 6/1981 Wood et al. ..... 134/11

FOREIGN PATENT DOCUMENTS 1098448 1/1968 United Kingdom .

OTHER PUBLICATIONS

"Hydration of Ions of Salts and Hydroxides in Saturated Solutions of NaCl-NaOH-$H_2O$, Kcl-KOH-$H_2O$, $NaNO_3$-NaOH-$H_2O$ and $KNO_3$-KOH-$H_2O$ at 25° C.", Termodinamika i Stroenie Rastvorov, 1973, (1), pp. 68-73.

*Primary Examiner*—John E. Kittle
*Assistant Examiner*—Robert A. Wax
*Attorney, Agent, or Firm*—William N. Hogg

[57] ABSTRACT

According to the present invention a saturated aqueous solution comprising at least one alkali metal hydroxide and at least one alkali metal nitrate is provided which can be spray added to a fused anhydrous bath which contains alkali metal materials.

16 Claims, No Drawings

AQUEOUS SOLUTION OF ALKALI METAL COMPOSITIONS

BACKGROUND OF THE INVENTION

This invention relates generally to materials for addition to fused salt baths, and more particularly to materials which are in aqueous solution for addition by spraying to fused, anhydrous salt baths.

U.S. Pat. No. 4,113,511 commonly assigned, teaches that aqueous solutions of chemicals can be added to fused non aqueous baths by spraying the aqueous solution of the chemicals over the surface of the bath in droplet size, small enough to allow the water to evaporate before the sprayed composition impinges on the surface.

U.S. Pat. No. 4,273,591 teaches an apparatus that is useful in performing such spray addition of chemicals in aqueous solution to a fused anhydrous bath.

It has been found, however, that many aqueous solutions of different alkali metal hydroxides and alkali metal nitrates for treating metals, such as for scale conditioning present various types of problems, and hence are less desirable for use in the above process and apparatus. It is therefore highly desirable to provide a balanced, stable aqueous solution of materials which will remain constant, and in solution, and which will spray uniformly and consistently under operating conditions in a commercial environment. This is especially necessary when making aqueous solution additions to fused anhydrous baths containing alkali metal salts.

SUMMARY OF THE INVENTION

According to the present invention, it has been found that a very good aqueous solution of material for addition to fused anhydrous metal treating baths containing alkali metal nitrate and alkali metal hydroxide is provided by an essentially saturated uniform aqueous solution comprising an alkali metal hydroxide and an alkali metal nitrate, wherein the solution is liquid at 50° C. and has a viscosity sufficiently low to be sprayed through nozzle means to form droplets, and which solution is free of precipitants between 50° C. and 110° C. The bath may contain other materials such as chlorides, permangantes, etc.

DESCRIPTION OF THE PREFERRED EMBODIMENTS

It has been found that in practicing the invention as described in the above noted U.S. Pat. No. 4,113,511, for adding alkali metal hydroxide and alkali metal nitrates to fused anhydrous metal treating baths it is extremely desirable to control the addition involved to certain types of aqueous solutions having very definite characteristics. By controlling the characteristics of the additional materials, certain detrimental effects such as unwanted precipitates, nozzle clogging, elimination of detrimental excess water, and composition imbalance can be reduced, or eliminated as well as providing a commercially economical addition system.

It has been found that when dealing with the alkali metal hydroxide alkali metal nitrate system, it is most advantageous to utilize a saturated aqueous solution of the alkali metal nitrate and the alkali metal hydroxide. The solution must be of sufficiently low viscosity to be sprayed through a nozzle to form droplets, and be liquid at 50° C.

It must also be free of precipitates between 50° C. and 110° C. As used herein the term "essentially saturated solution" means that the least soluble material or materials at the desired level of materials relative to each other be in essentially saturation amounts in the water, the remaining materials being in less than saturation amount. To determine this, the desired anhydrous balance of materials (including water of hydration) is first determined. When this has been determined just enough water is added to provide complete dissolution of the least soluble component, and to insure that the composition is liquid at 50° C., and the material has a low enough viscosity to be sprayed to form droplets, and is free of precipitates between 50° C. and 110° C.

Listed below are several examples of aqueous solutions including alkali metal hydroxide and alkali metal nitrates, as well as chlorides and permanganates in some examples.

EXAMPLE I

| | |
|---|---|
| 55% | WATER |
| 15% | SODIUM NITRATE |
| 30% | SODIUM HYDROXIDE |
| 100% | |

EXAMPLE II

| | |
|---|---|
| 53.6% | WATER |
| 30.0% | SODIUM HYDROXIDE |
| 15.0% | SODIUM NITRATE |
| 1.4% | POTASSIUM HYDROXIDE* |
| 100.0% | |

EXAMPLE III

| | |
|---|---|
| 57% | WATER |
| 30.0% | SODIUM HYDROXIDE |
| 3.6% | POTASSIUM HYDROXIDE* |
| 6.4% | SODIUM NITRATE |
| 3.0% | SODIUM CHLORIDE |
| 100.0% | |

EXAMPLE IV

| | |
|---|---|
| 60.0% | WATER |
| 31.4% | POTASSIUM HYDROXIDE* |
| 8.4% | SODIUM NITRATE |
| 0.2% | POTASSIUM PERMANGANATE |
| 100.0% | |

EXAMPLE V

| | |
|---|---|
| 55.0% | WATER |
| 21.6% | SODIUM HYDROXIDE |
| 21.2% | SODIUM NITRATE |
| 2.2% | SODIUM CHLORIDE |
| 100.0% | |

EXAMPLE VI

| | |
|---|---|
| 55.0% | WATER |

-continued

| | |
|---|---|
| 27.6% | SODIUM HYDROXIDE |
| 13.0% | SODIUM NITRATE |
| 1.4% | POTASSIUM HYDROXIDE* |
| 3.0% | SODIUM CHLORIDE |
| 100.0% | |

*Based on commercial grade of KOH at about 85% purity.

The saturation of the various materials is as follows:

EXAMPLE I

Sodium Nitrate saturated in the presence of caustic soda.

EXAMPLE II

Sodium Nitrate saturated in the presence of that much Hydroxide.

EXAMPLE III

Sodium Nitrate and Sodium Chloride saturated in the presence of that much Sodium and Potassium Hydroxide.

EXAMPLE IV

Nitrate ($NO_3^-$) saturated in the presence of that much Potassium Hydroxide.

EXAMPLE V

Sodium Chloride and Sodium Nitrate saturated in the presence of Sodium Hydroxide.

EXAMPLE VI

Nitrate ($NO_3^-$) and Chloride ($Cl^-$) saturated in the presence of that much Sodium and Potassium Hydroxide.

It should be noted that in aqueous solution the various materials are ionized and the saturation is determined by the concentration at which these ions form a reaction product which will precipitate.

All of the solutions in the above noted examples can be easily sprayed through a nozzle having an equivalent orifice diameter of 0.018" without clogging, at 50° C.

What is claimed is:

1. An essentially saturated aqueous solution comprising at least one alkali metal hydroxide and at least one alkali metal nitrate, characterized in that it is liquid at 50° C. and has a viscosity sufficient to be sprayed to form droplets, and further being stable and free of precipitates between 50° C. and 110° C., whereby the solution can be spray added to a fused salt bath of a composition comparable to the solution without water.

2. The invention as defined in claim 1 wherein the solution consists essentially of sodium nitrate, sodium hydroxide, and water.

3. The invention as defined in claim 2 wherein there is about 15% sodium nitrate and about 30% sodium hydroxide, balance water.

4. The invention as defined in claim 1 wherein the solution consists essentially of sodium hydroxide, sodium nitrate, sodium chloride, and water.

5. The invention as defined in claim 4 wherein there is about 21.6% of sodium hydroxide, about 21.2% sodium nitrate, and about 2.2% sodium chloride, balance water.

6. The invention as defined in claim 1 wherein the solution consists essentially of sodium hydroxide, sodium nitrate, potassium hydroxide, and water.

7. The invention as defined in claim 6 wherein there is about 30.0% sodium hydroxide, about 15.0% sodium nitrate, about 1.4% potassium hydroxide, balance water.

8. The invention as defined in claim 1 wherein the solution consists essentially of sodium hydroxide, potassium hydroxide, sodium nitrate, sodium chloride, and water.

9. The invention as defined in claim 8 wherein there is about 30.0% sodium hydroxide, about 3.6% potassium hydroxide, about 6.4% sodium nitrate, about 3.0% sodium chloride, balance water.

10. The invention as defined in claim 8 wherein there is about 27.6% sodium hydroxide, about 1.4% potassium hydroxide, about 13.0% sodium nitrate, about 3.0% sodium chloride, balance water.

11. The invention as defined in claim 1 wherein the solution consists essentially of potassium hydroxide, sodium nitrate, potassium permanganate, and water.

12. The invention as defined in claim 11 wherein there is about 31.4% potassium hydroxide, about 8.4% sodium nitrate, and about 0.2% potassium permanganate.

13. The invention as defined in claim 1 wherein the alkali metals include both potassium and sodium.

14. The invention as defined in claim 1, wherein the solution contains at least one alkali metal chloride.

15. The invention as defined in claim 1 wherein the solution contains at least one alkali metal permanganate.

16. A method of adding alkali metal compositions to a fused anhydrous bath of alkali metal compositions comprising the steps of providing a saturated aqueous solution of said alkali metal compositions, and spraying said solution above the surface of said fused anhydrous bath.

* * * * *